US005363682A

United States Patent [19]

Takeda et al.

[11] Patent Number: 5,363,682

[45] Date of Patent: Nov. 15, 1994

[54] FOUR-ROLLER TYPE SIZING MILL APPARATUS FOR PRODUCING ROUND STEEL RODS

[75] Inventors: Ryo Takeda; Eisuke Yamanaka; Hidenori Kondo; Kiyoji Ino; Hiroshi Hagihara, all of Okayama; Takaya Suzuki, Hokkaido; Sadao Yoshizawa, Hokkaido; Atsumu Nakamura, Hokkaido, all of Japan

[73] Assignees: Kawasaki Steel Corporation, Hyogo; Kotobuki Sangyo Co., Ltd., Hokkaido, both of Japan

[21] Appl. No.: 982,982

[22] Filed: Nov. 30, 1992

[30] Foreign Application Priority Data

Nov. 29, 1991 [JP] Japan ..... 3-316778
Aug. 19, 1992 [JP] Japan ..... 4-220065

[51] Int. Cl.[5] ..... B21B 13/12; B21B 35/04

[52] U.S. Cl. ..... 72/224; 72/235; 72/249

[58] Field of Search ..... 72/224, 225, 234, 235, 72/249

[56] References Cited

U.S. PATENT DOCUMENTS 2,094,920 10/1937 Inslee ..... 72/249
3,513,679 5/1970 Dechene et al. ..... 72/225
4,674,313 6/1987 Bald et al. ..... 72/245
4,864,838 9/1989 Engel et al. ..... 72/249

FOREIGN PATENT DOCUMENTS 0091904 7/1981 Japan ..... 72/224
0003703 1/1983 Japan ..... 72/224
0199206 9/1987 Japan ..... 72/224
0268501 11/1988 Japan ..... 72/235
0124302 5/1991 Japan ..... 72/224

*Primary Examiner*—Lowell A. Larson
*Assistant Examiner*—Thomas C. Schoeffler
*Attorney, Agent, or Firm*—Dvorak and Traub

[57] ABSTRACT

A four-roller type sizing mill apparatus for forming round steel rods, comprises two four-roller mills each having two pair of facing rollers. One pair of facing rollers is arranged in rolling direction perpendicular to the rolling direction of the other pair of rollers. The two four-roller mills are arranged in line, with the rolling direction of one of the two four-roller mills being shifted by 45° from the rolling direction of the other four-roller mill. The two pair of rollers of a first four-roller mill positioned closer to the rolling material inlet are separated from each other by a distance which is greater than zero and not greater than five times the projected contact length of one of the pair of rollers positioned closer to the rolling material inlet. The distance is measured between a first standard straight line which passes through the centers of one of the pair of rollers and lies on a plane parallel to the side surfaces of the same pair of rollers and a second standard straight line obtained by projecting the axes of the other pair of rollers onto the above-mentioned plane.

2 Claims, 12 Drawing Sheets

(PRIOR ART)

(PRIOR ART)

( PRIOR ART )

( PRIOR ART )

FOUR-ROLLER TYPE SIZING MILL APPARATUS FOR PRODUCING ROUND STEEL RODS

BACKGROUND OF THE INVENTION

1. FIELD OF THE INVENTION

The present invention relates to a four-roller type rolling mill apparatus for sizing bar and rod materials to give them round sectional shapes. More particularly, the present invention relates to a four-roller type sizing mill which achieves an increased maximum rolling draft for sizing while retaining a high sizing precision.

2. DESCRIPTION OF THE RELATED ART

In general, a heated steel material is continuously rolled into a round rod having a desired size by a line of a plurality of rolling mills including roughing mills and finishing mills having grooved caliber rollers. Sizing mills are usually used at the final stages in the finishing mills.

The rolling methods using sizing mills fall into three types on the basis of the number of rollers in the first stand of the sizing mills. These types are the two-roller method, three-roller method and four-roller method, as shown in FIGS. 10(*a*), 10(*b*) and 10(*c*), respectively. A rolling material w is rolled through passes formed by the grooves 20*a*, 22*a* and 25*a* of the rollers belonging to the respective roller units which are set with respect to different rolling directions, for example, through a pass between rollers 20 and 21 and then a pass between rollers 20' and 21' in FIG. 10(*a*). As shown in the figures, rollers 20 to 28 have grooves 20*a*, 22*a* and 25*a* having predetermined sectional shapes.

Japanese Patent Application Laid-Open No. 1-202302 discloses a two-roller sizing method in which a material is rolled through three passes each of which is formed by two rollers and has rolling directions different from those of the other two passes. Japanese Patent Application Laid-Open No. 63-43072 discloses a three-roller sizing method in which a material is rolled through three passes each of which is formed by three rollers and has rolling directions different from those of the other two passes. Japanese Patent Application Laid-Open No. 62-199206 discloses a four-roller sizing method in which a material is rolled through two passes each of which is formed by four rollers and has rolling directions different from those of the other pass.

Three rolling methods as shown in FIGS. 10(*a*) to 10(*c*) were tested to compare their performances. In the test, the same type of rolling material w having a diameter d of 50 mm was sized by each of the three methods. The shapes of the grooves 20*a*, 22*a* and 25*a* of the rollers used to form the final-stage passes were as shown in FIGS. 11(*a*), 11(*b*) and 11(*c*), respectively. Radii R1, R2 and R3 of the grooves were all 25 mm, and the central angles of the grooves were: $\theta_1=90°$, $\theta_2=60°$, and $\theta_3=45°$ The sectional views of the obtained round steel rods are shown in FIGS. 12(*a*), 12(*b*) and 12(*c*). The two-roller method produced a sectional shape of a quadrangular circle as shown in FIG. 12(*a*). The three-roller method produced a sectional shape of a hexagonal circle as shown in FIG. 12(*b*). The four-roller method produced a sectional shape of an octagonal circle as shown in FIG. 12(*c*).

The difference between the maximum diameter $d_1$ and the minimum diameter $d_2$ of each round steel rod (referred to as "diameter difference") was examined in relation to the rolling draft.

If a rolling draft is too large, the rolling material over-fills into the gaps between the rollers, resulting in a defect. Referring to FIG. 13, point t where the straight line segments (actually the flat areas), for example, 25*c* and 26*c* in the figure, of the grooves of two neighboring rollers, for example, 25 and 26, were defined as the points of over-filling limit, that is, the points of critical rolling draft. Rolling drafts were measured which caused the rolling material to fill up to the points of over-filling limit.

The graph in FIG. 14 is based upon these results, indicating the relation between diameter differences and rolling draft as well as the over-filling limits by arrows ↓. As indicated by the graph, the four-roller method achieves a higher sizing-precision than the other methods with respect to the same rolling draft, but the four-roller method results in over-filling with less rolling draft than the other two methods. In other words, the four-roller method can perform sizing only in limited ranges of rolling drafts. On the other hand, the two-roller method fails to achieve a high sizing-precision, but can perform sizing in a wider range of rolling drafts than the other two methods, without suffering over-filling.

FIG. 15 indicates the relation between the rolling reduction and the width expansion of round steel rods obtained by the three methods, the width expansion being obtained on the basis of the following calculation: [(the width of material after rolling—the width of material before rolling)/the width of material before rolling]×100. As indicated by the graph in FIG. 15, the two-roller method causes a greater width expansion than the other two methods, and the three-roller method causes a greater width expansion than the four-roller method, with respect to the same rolling reduction.

If there is a large width expansion, changes in the width greatly vary depending on the type of steel material and the rolling conditions, such as temperature or rolling speed, even when the rolling draft is maintained at a constant level. In other words, the sizing-precision in the two-roller method is subject to greater deterioration. Thus, the four-roller method has, again, advantages with regard to sizing precision.

Considering the results of the experiments described above, if the sizing precision is not critical, the two-roller method is more useful than the other two methods because the two-roller method allows a greater range of rolling drafts for sizing. If the sizing precision is critical, the four-roller method is more advantageous than the other two methods.

However, since a unit of rollers of the four-roller type mills can perform sizing only in a limited range of rolling drafts, the rollers must be changed frequently in order to provide a desired rolling draft. To change rollers, the rolling operation must be stopped, thus significantly deteriorating operating efficiency.

The structure of a rolling mill becomes more complicated in the order of the two-roller method, the three-roller method and the four-roller method. More specifically, as the number of roller driving devices increases, adjustment of the roller gaps and adjustment of position of the rollers along their own axes become more delicate.

A known four-roller type mill must have four roller-driving devices because each of the four rollers needs a torque to rotate. Further, these four driving devices of the four-roller type mill must be electrically synchronized. Thus, a known four-roller type mill requires a great number of parts and components and, therefore, a complicated structure, inevitably becoming bulky and expensive.

Further, to change rollers in a known four-roller type mill, the roller driving device including motors and spindles must be removed from the main body. Still further, because the roller driving device including motors are provided around the rollers, changing or maintaining the rollers is not very easy.

As described above, though the four-roller method has an advantage in improving sizing-precision, it has several problems, such as the requirement for the complicated structure or frequently changing rollers. Therefore, the four-roller method has not been widely used in sizing mills.

SUMMARY OF THE INVENTION

Accordingly, an object of the present invention is to provide a novel four-roller type sizing mill in which a unit of rollers achieves a wide range of rolling drafts for sizing and a simplified structure to facilitate changing and maintaining the rollers.

To achieve the objects, the present invention provides a four-roller type sizing mill apparatus for forming round steel rods comprising two four-roller mills each having two pair of facing rollers. One pair of facing rollers is arranged in a rolling direction perpendicular to the rolling direction of the other pair of facing rollers. The two four-roller mills are arranged in line, with the rolling direction of one of the two four-roller mills being shifted by 45° from the rolling direction of the other four-roller mill. The two pair of facing rollers of a first four-roller mill of the two four-roller mills are positioned closer to a rolling material inlet and are separate from each other by a distance which is greater than zero and not greater than five times a projected contact length of one of the pair of facing rollers positioned closer to the rolling material inlet. The distance is measured between a first standard straight line which passes through the centers of one of the pair of facing rollers and lies on a plane parallel to the side surfaces of the same pair of facing rollers and a second standard straight line obtained by projecting the axes of the other pair of facing rollers onto the above-mentioned plane.

Further objects, features and advantages of the present invention will become apparent from the following description of the preferred embodiments with reference to the attached drawings.

DESCRIPTION OF THE PREFERRED EMBODIMENT

The preferred embodiments of the present invention will be described hereinafter, with reference to the accompanying drawings.

Figure 3:
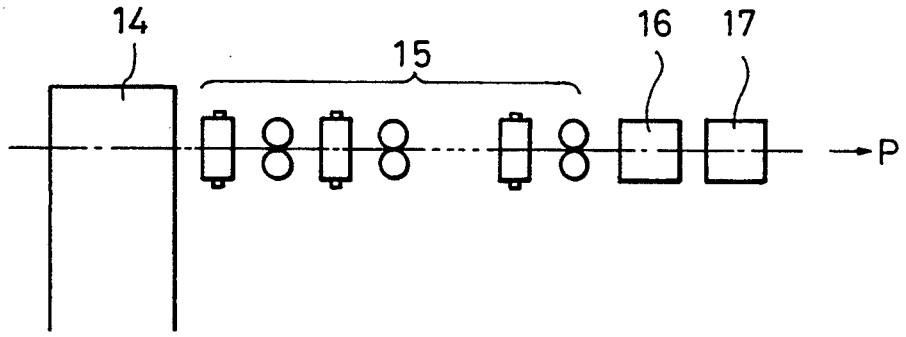
FIG. 3 schematically illustrates the steps of a rolling process according to the present invention.

FIG. 3 illustrates, generally, the steps of a rolling process according to the present invention. A furnace 14 for heating a rolling material to a high temperature is placed at an upstream position. Downstream therefrom, a plurality of two-roller roughing mills 15 are arranged in line, with the rolling direction of two neighboring two-roller mills being substantially perpendicular to each other. Two stands of a four-roller mill according to the present invention, that is, the first stand 16 and the second stand 17, are provided at a downstream position. An arrow P in the drawing indicates the conveying direction or the pass line of a material.

The first stand 16 of the four-roller mills of the present invention will be described with reference to FIG. 1.

A pair of rollers 1 and 2 are arranged in a unit 10 so that grooves 1*a* and 2*a* of the rollers 1 and 2 are vertically aligned and face each other. Another pair of rollers 3 and 4 are arranged in the unit 10 so that the grooves 3*a* and 4*a* of the rollers 3 and 4 are horizontally aligned and face each other. These four rollers 1 to 4 form a substantially circular roller gap. Shafts 1*b* to 4*b* of the rollers 1 to 4 may be rotatably connected to the unit 10 by four-roller type mill of roller neck bearings (not shown), respectively.

Figure 2:
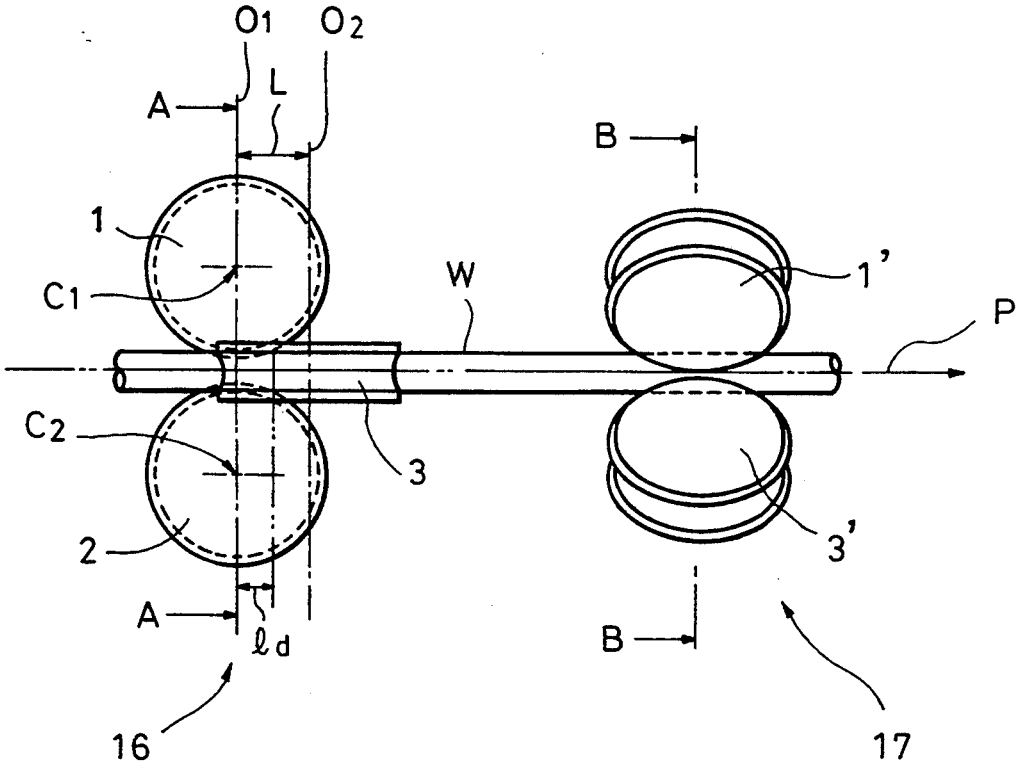
FIG. 2 is a schematic side view of the four-roller type rolling mill apparatus according to the embodiment of the present invention.

More specifically, the four rollers 1 to 4 are arranged as shown in FIG. 2. A first standard straight line $O_1$ which passes through the centers C1 and C2 of a pair of rollers 1 and 2 and lies on a plane parallel to the side surfaces of the pair of rollers 1 and 2 (e.g., a plane of the sheet of the drawing) is separated by a distance L from a second standard straight line $O_2$ obtained by projecting the axes of the other pair of rollers 3 and 4. This distance L will be referred to as "the distance L" hereinafter.

The distance L is 0 in the conventional four-roller type mills, whereas the four-roller type mill of the present invention has two pair of rollers which are separated from each other ($L>0$). In the four-roller type mill of the present invention, a rolling material is rolled by a first pair of rollers and then by a second pair of rollers which are placed downstream from the first pair of rollers. The advantages of both the two-roller type mill and the four-roller type mill can be achieved by appropriately adjusting the distance L. More specifically, the for-sizing rolling draft of a unit of rollers is increased compared with the conventional four-roller type mill (an advantage of the two-roller type mill). Further, sizing-precision is improved compared with the conventional two-roller type mill (an advantage of the four-roller type mill).

As the distance L becomes larger, this four-roller type mill becomes more like two conventional two-roller type mills. Experimental rolling was performed by using four-roller type mills having different distances L, and the width expansions of the resulting round steel rods were measured. The relation between the width expansions and the ratios ($L/l_d$) of the distances L to the projected contact lengths $l_d$ of one of the pair of rollers closer to the inlet of rolling materials was studied. A projected contact length $l_d$ is defined as the length of an area obtained by projecting the contact area between the roller 1 and the rolling material onto the pass line P in FIG. 2.

Figure 5:
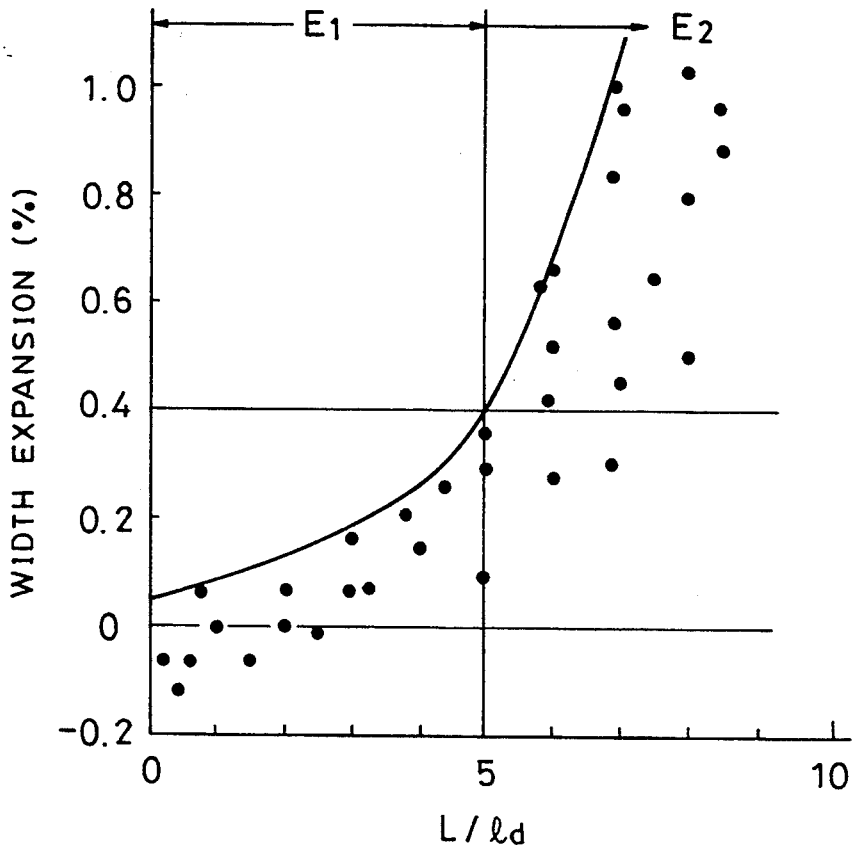
FIG. 5 is a graph indicating the relation between the width expansion and the ratio ($L/l_d$) of the distance L between the two pair of rollers of a four-roller type mill to the projected contact length $l_d$ of one of the pair of rollers being closer to the inlet of rolling material.

The results are shown in FIG. 5. As indicated in the graph in FIG. 5, a ratio $L/l_d$ greater than five causes a significantly large width expansion. Therefore, according to the present invention, the distance L should be greater than zero but not greater than five times the projected contact length $l_d$.

FIG. 5 illustrates that, if the ratio is in the range $E_1$ according to the present invention, that is, $L/l_d \leqq 5$, the width expansion of a rolling material can be maintained at low levels. In this range of the ratio $L/l_d$, the two pair of rollers of the four-roller type mill of the present invention are comparatively close to each other, the four-roller type mill achieves the advantage of the conventional four-roller type mill, that is, low width expansion. If the ratio is out of the range $E_1$ according to the present invention, in other words, $L/l_d>5$ (range $E_2$), the width expansion becomes significantly great. In this range of the ratio $L/l_d$, the two pair of rollers of the four-roller type mill are relatively far away from each other and the four-roller type mill becomes more like two conventional two-roller type mills causing high width expansion.

Figure 6:
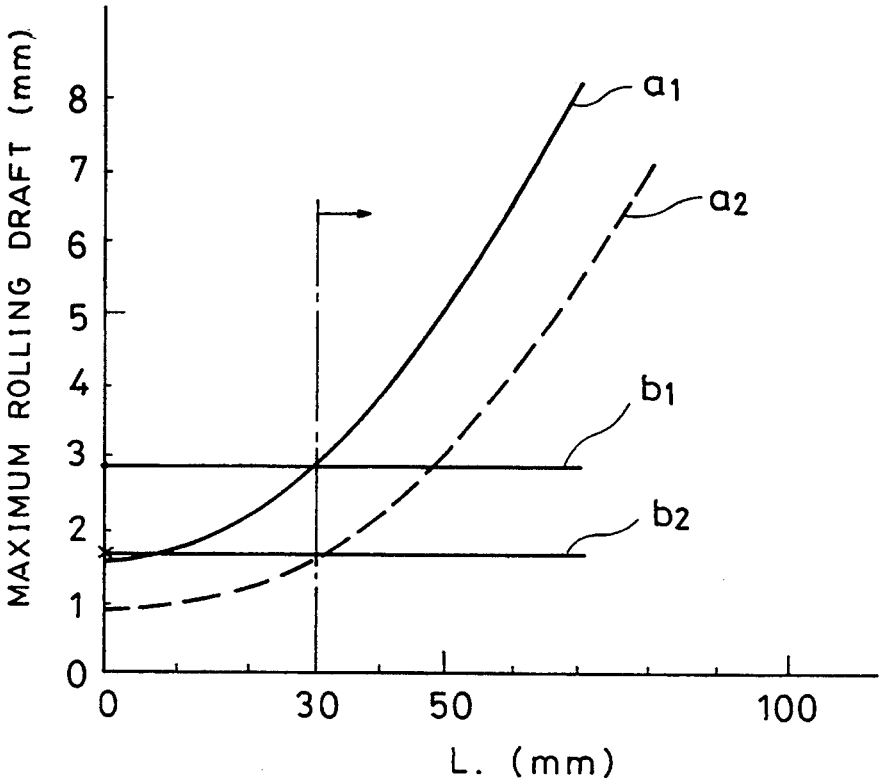
FIG. 6 is a graph indicating the relation between the distance L and the maximum rolling draft.

FIG. 6 is a graph indicating the relation between the distances L and the maximum rolling drafts. In other words, the rolling draft which fills the pass to the points of over-filling limit as described above. The solid-line curve $a_1$ was obtained when the radius of curvature of the groove of the rollers (denoted by $R_3$ in FIG. 11(C)) was 25 mm. The broken-line curve $a_2$ was obtained when the radius of curvature $R_3$ was 15 mm. The straight lines b1 and b2 indicate the maximum rolling drafts of conventional three-roller type mills in which the radius of curvature of the grooves are 25 mm and 15 mm, respectively. The lines b1 and b2 were also obtained in experiments.

FIG. 6 indicates that the four-roller type mill of the present invention will achieve maximum rolling draft for sizing as great as or greater than that achieved by the conventional three-roller type mill if the distance $L \geqq 30$ mm.

The distance L is appropriately determined within the above-mentioned range, considering various conditions such as a certificated level of dimensional tolerance of the products or a target level of rolling efficiency. After many rolling experiments, the inventors have found that the suitable range of the distance L is 30 mm $\leqq L \leqq$ two times the projected contact length ($2l_d$).

Other components and structure of the four-roller mill of the present invention will be described with reference to FIG. 1.

Each of the shafts 1*b* and 2*b* of the rollers 1 and 2 whose grooves are vertically aligned is connected at one end thereof to an end of a spindle 5*a* and 5*b* by a coupling 6*a* and 6*b*, respectively. The other ends of the spindles 5*a* and 5*b* are connected to pinion gears 8*a* and 8*b* by couplings 7*a* and 7*b*, respectively. The two pinion gears 8*a* and 8*b* are engaged with each other, and a pinion gear 8*b* is connected to a shaft of a driving motor 9. The roller driving device is comprised of: the couplings 6*a*, 6*b*, 7*a*, 7*b*; the spindles 5*a* and 5*b*; the pinion gears 8*a* and 8*b*; and the driving motor 9. The pinion gears 8*a* and 8*b* are rotatably supported in a pinion stand 11. FIG. 1 shows the shafts 1*b* and 2*b* of the rollers 1 and 2 which are separated from the couplings 6*a* and 6*b*.

On the other hand, the pair of rollers 3 and 4 whose grooves are horizontally aligned are rotatably connected to shafts 3*b* and 4*b*, respectively, but not connected to driving sources such as motors.

The four-roller mill further comprises a screw down device (not shown) which adjusts the width of the gap of the facing rollers by using eccentric means, such as an eccentric sleeve, for adjusting the roller gap so that the gap becomes symmetric about the pass line. An axial position adjusting device, such as a screw nut type adjusting device, may be included for correcting a shift of the center of the pass of the facing rollers, the shift being along the axes of the rollers.

As shown in FIG. 2, the second stand 17 of the four-roller type mill, that is, the stand closer to the outlet of the rolling material, is constructed substantially in the same manner as the first stand 16, except that the roller axes are shifted 45° from those of the first stand 16 and that the distance L is zero.

As shown in FIG. 3, a rolling material w is heated to a high temperature by the furnace 14, rolled into a substantially circular sectional shape by the array 15 of the two-roller type mills and then conveyed into the inlet side of the first stand 16 of the four-roller type mill.

Before the rolling material is conveyed into the four-roller type mill, the following preparations have been made. In each of the first and second stands 16 and 17, the gap between the two pair of rollers 1 to 4 is adjusted in accordance with the product by the screw down device (not shown), thereby suitably determining the rolling force of the rollers applied to the rolling material. Further, shifting of the centers of the passes 1*a* to 4*a* of the rollers are corrected by the axial position adjusting device (not shown). Torque is supplied from the driving motor 9 and transmitted by the pinion gears 8*a* and 8*b* and spindles 5*a* and 5*b* to the shafts of the vertically aligned rollers 1 and 2. Thus, the rollers 1 and 2 rotate, mechanically synchronized by the pinion gears 8*a* and 8*b* which are engaged with each other. The horizontally aligned rollers 3 and 4 are not rotated by driving means.

When the rolling material w rolled by the two-roller mill array 15 reaches the first stand 16 of the four-roller type mill, the front end portion of the rolling material w is bitten between the grooves of the vertically aligned rollers 1 and 2 of the first stand 16. Due to the rolling torque of the rollers 1 and 2 and the friction between the rollers 1 and 2 and the rolling material, the rolling material is conveyed through the gap between the rollers 1 and 2 and then the gap between the rollers 3 and 4. The rollers 3 and 4 which are not connected to a driving motor are rotated by the movement of the rolling material w. The rolling material is then conveyed to the second stand 17, where the rolling material is rolled by the rollers whose axes are shifted 45° from those in the first stand. A round steel rod is thus produced.

The structure is simplified because the rollers 3 and 4 of the first and second stands 16 and 17 of the four-roller type mill are not connected to driving motors or spindles. Further, the simplified structure creates an increased working space for the adjustments of the roller gaps and the position of a roller along its axis, thus facilitating these operations.

Figure 1:
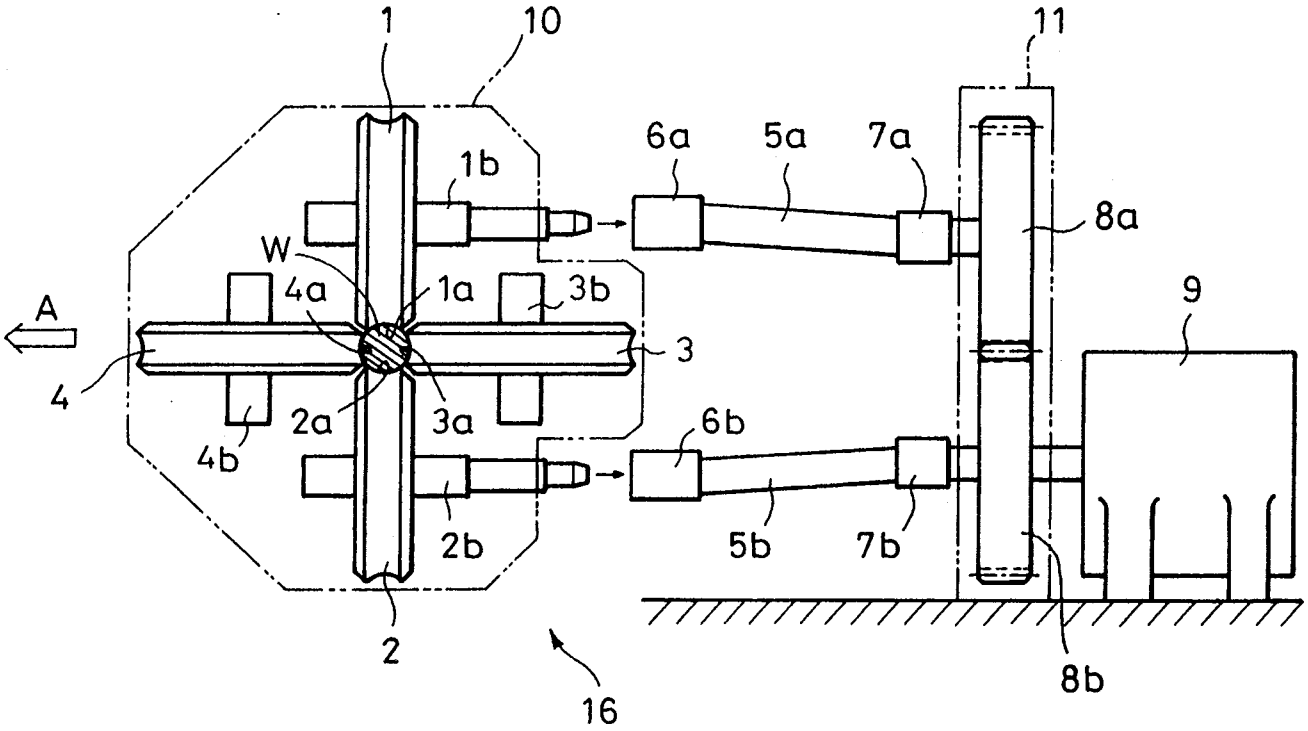
FIG. 1 is a schematic front view of a four-roller type rolling mill apparatus according to an embodiment of the present invention.

The rollers may be easily changed because the unit 10 is separable from the spindles 5*a* and 5*b* by moving the unit 10 toward the left in FIG. 1 (in the direction indicated by the arrow A). Maintenance may also be more easily performed.

Though one motor 9 is used to drive the vertically-aligned pair of rollers 1 and 2 in the above embodiment, two driving motors may be used to drive the rollers 1 and 2, respectively. Further, the horizontally-aligned rollers 3 and 4 may be driven instead of the rollers 1 and 2.

In the above embodiment, the rollers 3 and 4 are not connected to a driving source. This may cause a problem, however. If the rolling force is set to a certain level or higher by the screw down device, the front end portion of a rolling material may hit the groove surface of the not-rotated rollers 3 and 4 too strongly. Such a strong force may cause damage to the groove surfaces of the rollers 3 and 4. Naturally, a flaw on the groove surface of a roller causes damage to the surface of the rolled rod.

Figure 4:
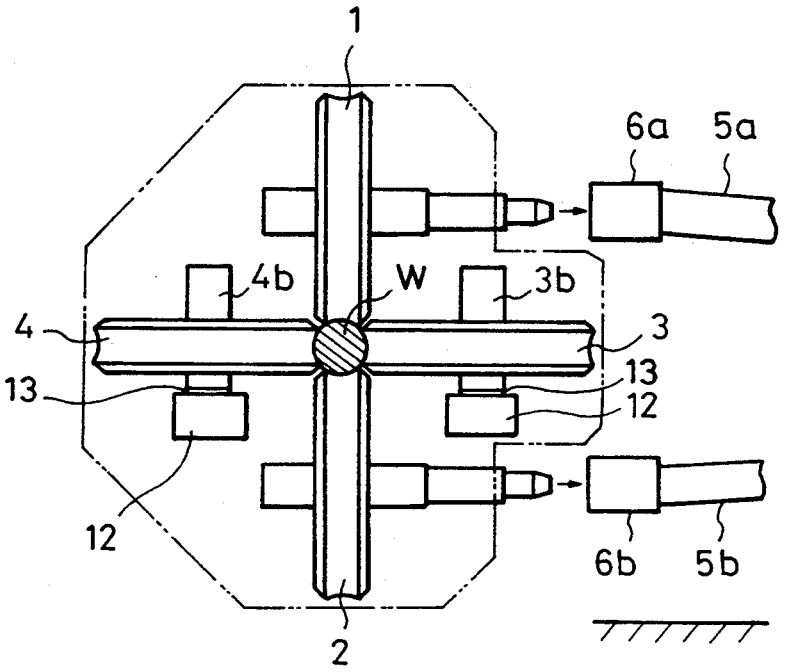
FIG. 4 is a schematic front view of a four-roller type rolling mill apparatus according to another embodiment of the present invention.

To prevent this, the shafts 3*b* and 4*b* of the horizontally-aligned rollers 3 and 4 are connected to small motors 12 and 12, respectively, according to another embodiment as shown in FIG. 4. The small motors 12 are connected to the unit 10 and thus form pre-rotating devices. The small motors provide the rollers 3 and 4 with a torque just large enough to rotate the rollers 3 and 4 when the rollers 3 and 4 are free, that is, when the rollers 3 and 4 are not rolling a material. Further, the pre-rotating devices including the small motors 12 rotate the rollers 3 and 4 in the same direction and at substantially the same rotational speed as those of the vertically-aligned rollers 1 and 2 which are driven by the roller driving device.

Because the rollers 3 and 4 are rotated at substantially the same speed as the conveying speed of the rolling material by the small motors 12 (which provide torque not so large as to rotate the rollers 3 and 4 for rolling but just large enough to rotate them when they are free), the front end of a rolling material does not strongly hit but softly contacts the groove surfaces of the rollers 3 and 4 even if the rolling force is set at a high level. Thus, the possibility of forming flaws on or damage to the groove surfaces of the rollers 3 and 4 is substantially eliminated.

The rolling material is conveyed from the inlet side to the outlet side of the four-roller type mill by the rolling torque of the vertically-aligned rollers 1 and 2. During conveyance of the rolling material, the horizontally-aligned rollers 3 and 4 are rotated, in effect, by the movement of the rolling material; not by the torque provided by the small motors 12, which is not large enough for rolling.

Because the small motors 12 for driving the horizontally-aligned rollers 3 and 4 are required to provide just enough torque to rotate the rollers 3 and 4 when they are free instead of torque so large as to rotate the rollers 3 and 4 for rolling, the pre-rotating devices including the motors 12 can be made small. The reduced size of these devices leaves increased working space for changing and maintaining the rollers, thus facilitating these operations.

Alternatively, the small motors 12 may be disconnected from the horizontally-aligned rollers 3 and 4 after the front end portion of a rolling material w is bitten in the gaps between the rollers 1 to 4. After that, the rollers 3 and 4 are rotated solely by the movement of the rolling material w.

The pre-rotating devices for rotating the horizontally-aligned rollers 3 and 4 may be known pre-rotating devices, such as hydraulic or pneumatic turbines.

Still further, the rotation of the rollers 3 and 4 driven by the pre-rotating devices may be controlled at substantially the same speed as the rotation of the rollers 1 and 2 driven by the roller driving device, either by providing means, such as a rotation detecting sensor, in the driving motor 9 for electrically synchronizing the rotations of the two pair of rollers or by pre-setting the pre-rotating devices so that the devices rotate at a predetermined speed which is found most suitable from experience.

In the construction as described above, however, if a rolling material w is heavy, it may stop in the four-roller type mill during the rolling process. When the rear end of a heavy rolling material w has come out of the two-roller type mill array 15, the rolling torque provided solely by the four-roller type mill may not suffice for continuing to roll the heavy rolling material w because one pair of rollers in each of the stands 16 and 17 do not provide torque.

To ensure that a rolling material will be constantly conveyed without stopping, the pre-rotating devices for rotating the pair of rollers which are not driven by the roller driving device may be provided with one-way clutches 13, as shown in FIG. 4.

The one-way clutches 13 do not transmit torque from the small motors 12 to the rollers 3 and 4 but freely rotate while a rolling material w is being rolled at a sufficiently high speed. When the rolling speed of the rolling material w is decreased, the one-way-clutches 13 engage to transmit the torque of the small motors 12 to the rollers 3 and 4, thus helping to convey the rolling material w.

EXAMPLES

Figure 7A:
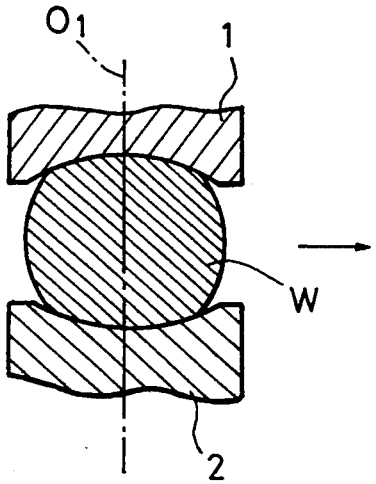
FIGS. 7(*a*) and 7(*b*) are enlarged sectional views of the pass portions of the upstream four-roller type mill, taken along lines A—A of FIG. 2.
Figure 7B:
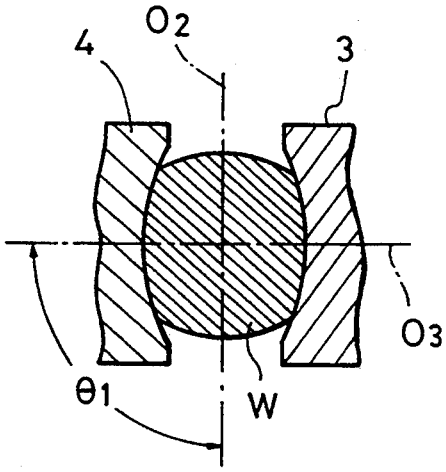
Figure 8:
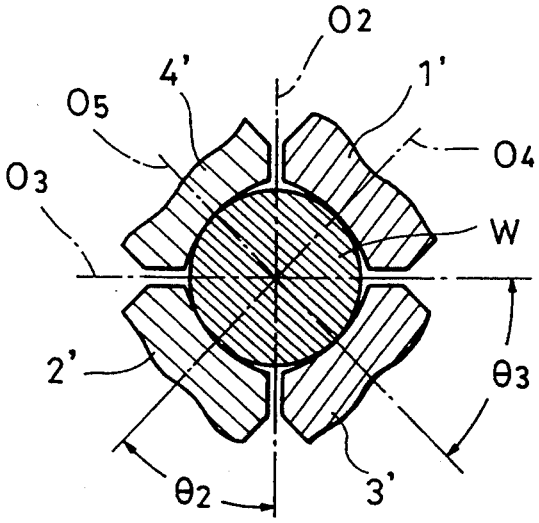
FIG. 8 is an enlarged view of the pass portion of the downstream four-roller type mill, taken along the line B—B of FIG. 2.

Examples of the present invention will be described with reference to FIGS. 2, 7(*a*), 7(*b*) and 8. FIG. 2 is a schematic side view of the four-roller type mill of the present invention. FIGS. 7(*a*) and 7(*b*) are enlarged sectional views of the pass portions taken along line A—A of FIG. 2. FIG. 8 is an enlarged sectional view of the pass portion taken along line B—B of FIG. 2. Referring to FIG. 2, two stands 16 and 17 of the four-roller type mill were arranged along the pass line P. Each stand had four rollers. One pair of rollers 1 and 2 of the first stand 16 were set to vertically roll a rolling material w, and the other pair of rollers 3 and 4 were set to horizontally roll the rolling material w. The two pair of rollers were separated from each other by a distance L defined as follows. The distance L is measured between a first standard straight line $O_1$ which passes through the centers C1 and C2 of the pair of rollers 1 and 2 and lies on a plane parallel to the side surfaces of the pair of rollers 1 and 2 (e.g., the plane of the drawing) and a second standard straight line $O_2$ obtained by projecting the axes of the other pair of rollers 3 and 4 onto the above-mentioned plane.

Although the first stand 16 has four rollers, this stand may be viewed as a unit of two two-roller mills leaving the distance L therebetween: one two-roller mill having the pair of rollers 1 and 2 as shown in FIG. 7(*a*); and another two-roller mill having the pair of rollers 3 and 4 as shown in FIG. 7(*b*).

The rolling material w was rolled in the first pass in a rolling direction along the first standard straight line $O_1$, as shown in FIG. 7(*a*), and then in the second pass in a rolling direction along a straight line $O_3$ extending perpendicularly to the second standard straight line $O_2$ (in other words, $\theta_1=90°$ ), as shown in FIG. 7(*b*). Then the rolling material w is conveyed to the second stand 17 placed closer to the rolling material outlet. The two pair of rollers 1' to 4' of the second stand 17 were arranged as shown in FIG. 8. The angle $\theta_2$ between a line $O_4$ indicating the rolling direction of a pair of rollers 1' and 2' and the line $O_2$ indicating the rolling direction of the pair of rollers 1 and 2 of the first stand was 45° . The angle $\theta_3$ between a line $O_5$ indicating the rolling direction of the other pair of rollers 3' and 4' and the line $O_3$ indicating the rolling direction of the pair of rollers 3 and 4 of the first stand was also 45° .

Using an array of rolling mills including the above-described first and second stands 16 and 17 of the four-roller type mill, rolling materials having substantially circular sectional shapes were rolled for sizing by a method according to the present invention, under the following conditions.

Figures 11A, 11B, 11C:
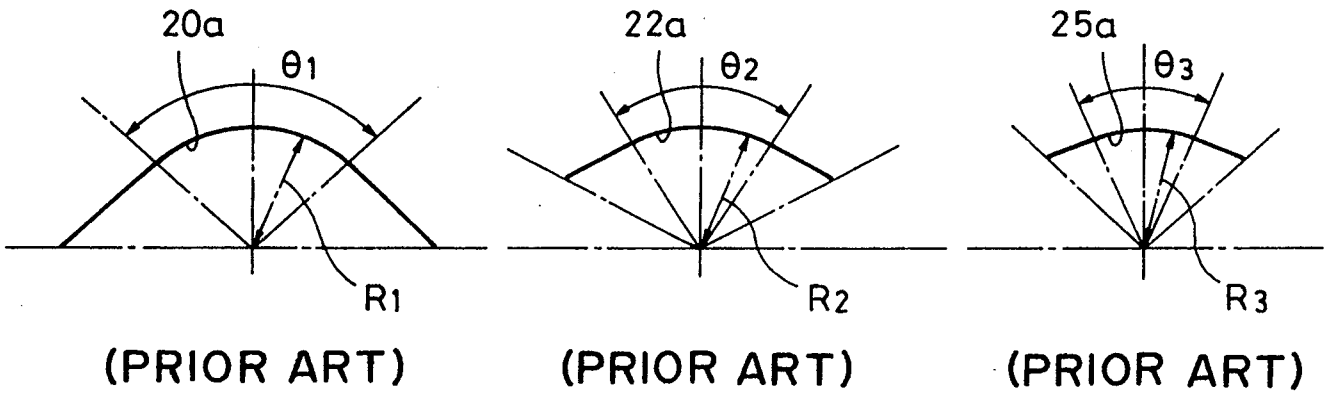
FIG. 11(a) (PRIOR ART)
FIG. 11(b) (PRIOR ART)
FIG. 11(c) (PRIOR ART)
FIGS. 11(*a*) to 11(*c*) schematically illustrate the groove shapes of the rollers used in experiments.
Figure 12A:
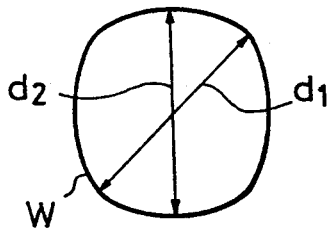
FIGS. 12(*a*) to 12(*c*) schematically illustrate the ranges of diameters of round rods formed by different types of rolling mill apparatuses.
Figure 12B:
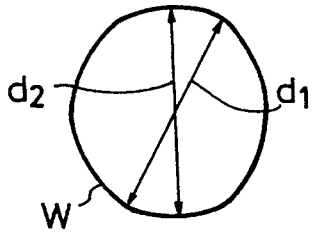
(PRIOR ART) FIG. 12(b)
Figure 12C:
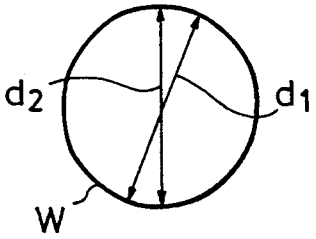
(PRIOR ART) FIG. 12(c)
Figure 13:
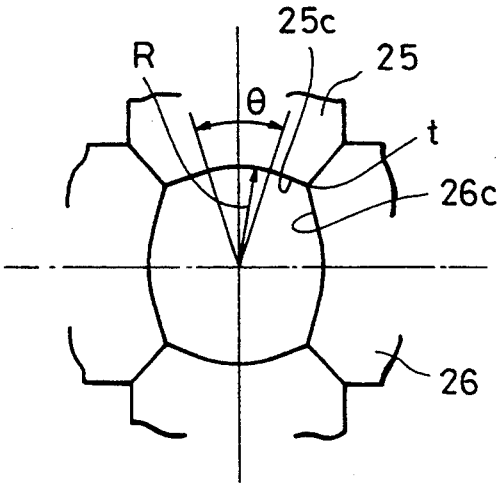
(PRIOR ART) FIG. 13
FIG. 13 schematically illustrates the points of overfilling limit which were defined in the experiments.
Figure 14:
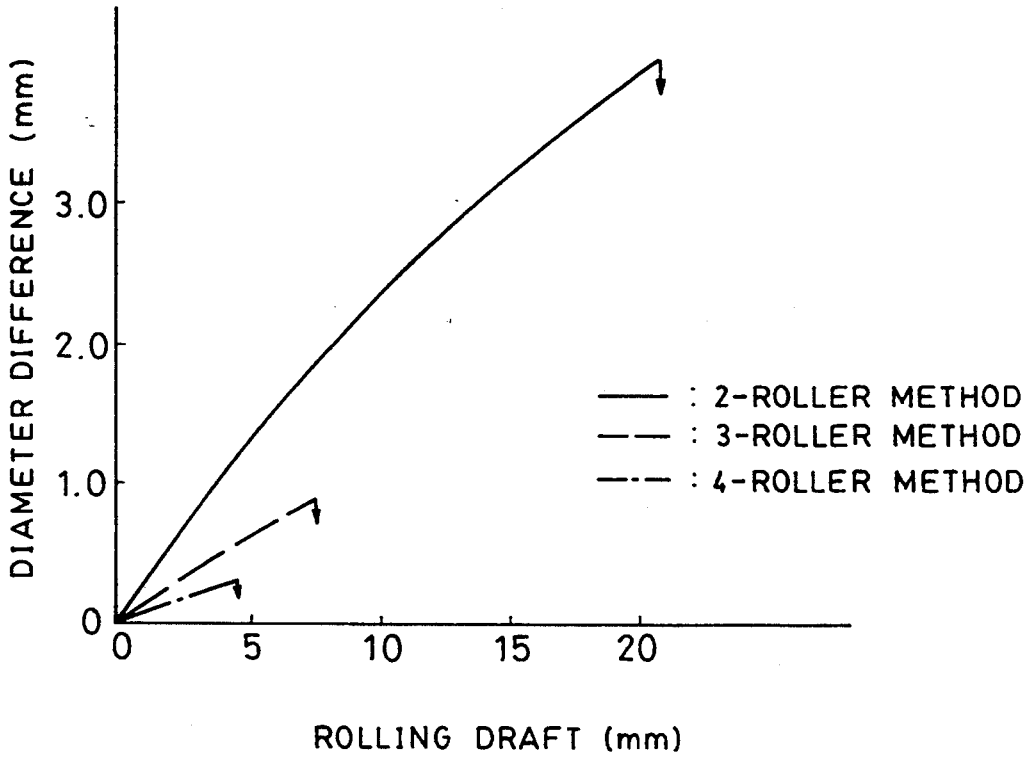
FIG. 14 is a graph indicating the relations between rolling draft and diameter differences according to the known art.
Figure 15:
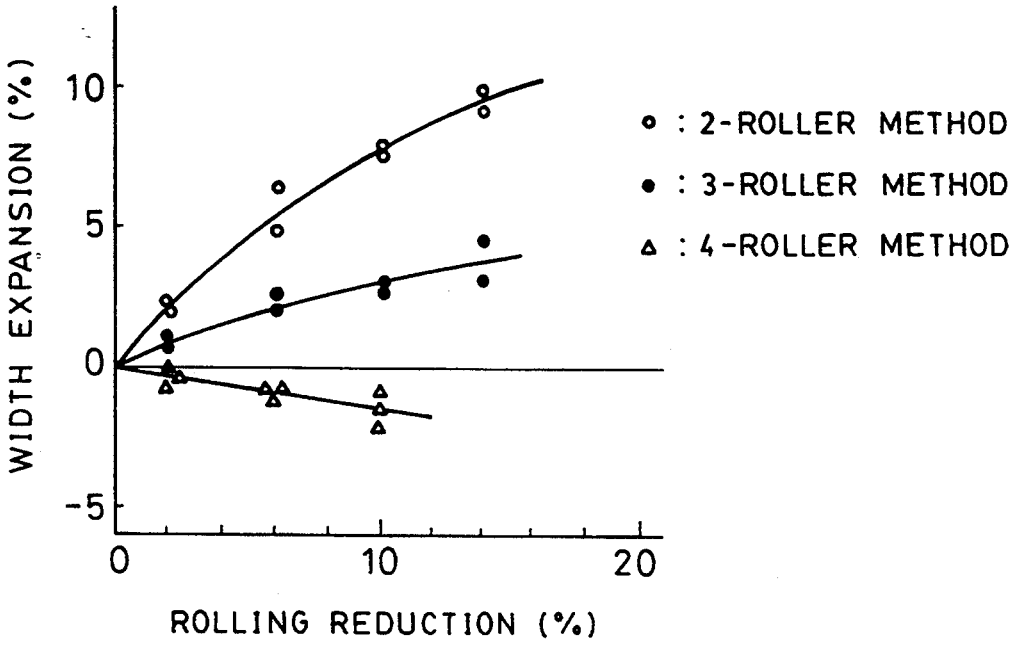
FIG. 15 is a graph indicating the relations between rolling reduction and width expansion according to the known art.

| Rolling Conditions: | |
|---|---|
| Steel Type | S45C |
| Rolling Temperature | 850 to 900° C. |
| Diameters of Materials (mm) | 21, 33, 44, 55 |
| Diameter of Rollers | 380 mm |
| Passes of Rollers (see FIG. 11(c)) | |
| Central Angles $\theta_3$ = 45° | |
| Radii of Curvature $R_3$ (*mm*) | 10.0, 16.0, 21.5, 27.0 |
| Rolling Draft | 1.0 to 5.0 mm |
| Distance L | 40 to 60 mm |
| ($L/l_d$) | (1.5 to 4.4) |

The rolling materials having the above diameters were rolled with the rolling drafts of 1.0 to 5.0 mm, thus obtaining products having a wide variety of diameters compared with a conventional four-roller type mill, as shown in Table 1.

TABLE 1

| Diameters of Materials (mm) | $R_3$ (mm) | Diameters of Products (mm) |
|---|---|---|
| 21 | 10.0 | 20 to 16 |

TABLE 1-continued

| Diameters of Materials (mm) | $R_3$ (mm) | Diameters of Products (mm) |
|---|---|---|
| 33 | 16.0 | 32 to 28 |
| 44 | 21.5 | 43 to 39 |
| 55 | 27.0 | 54 to 50 |

Figure 9:
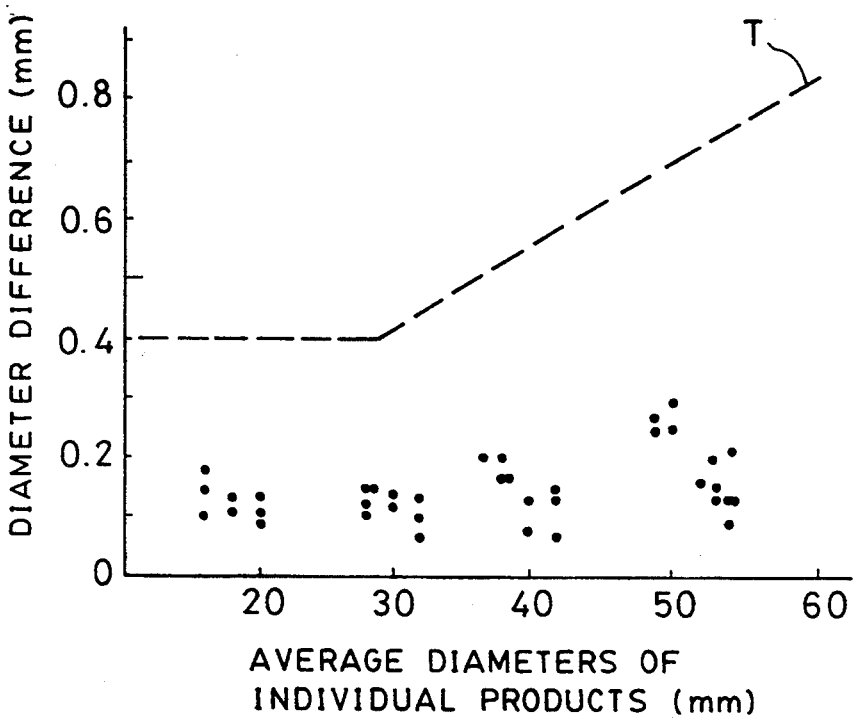
FIG. 9 is a graph indicating the relation between the average diameters and diameter differences of the individual round steel rods formed by the apparatus of the invention.
Figure 10A:
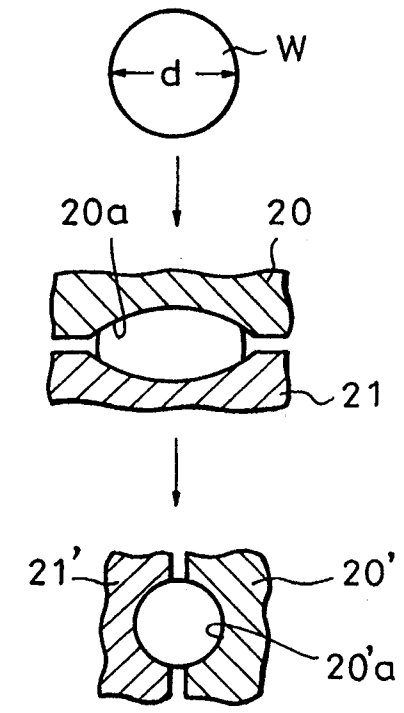
FIGS. 10(*a*), 10(*b*) and 10(*c*) are schematic illustrations of examples of known rolling mill apparatuses of two-roller type, three-roller type and four-roller type, respectively.
Figure 10B:
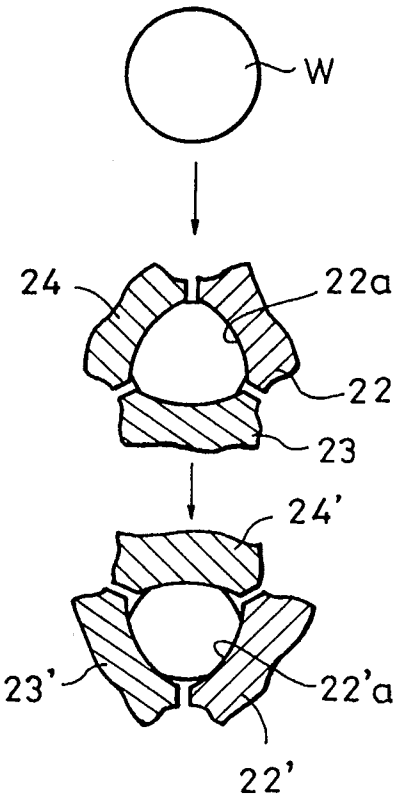
(PRIOR ART) FIG. 10(b)
Figure 10C:
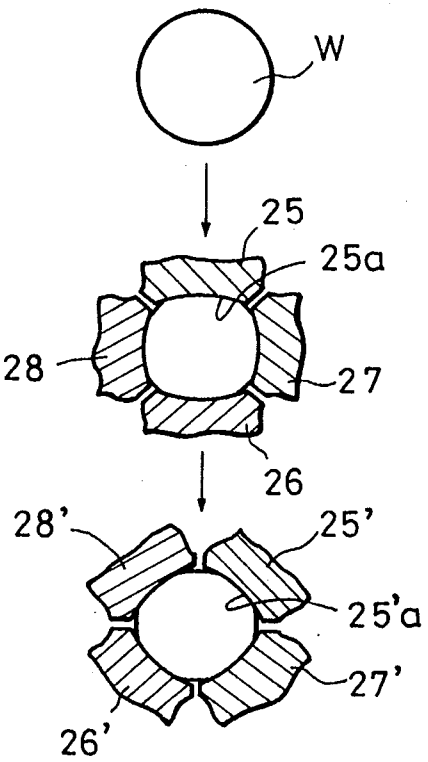
(PRIOR ART) FIG. 10(c)

Further, the difference between the maximum diameter and the minimum diameter of each of the round steel rods (products) was measured. The graph in FIG. 9 indicates the relation between the thus-obtained diameter differences and the average diameters of individual products (i.e., "diameters of products" in Table 1). In the graph, the broken line T indicates the tolerance according to the Japanese Industrial Standard (JIS).

As indicated in the graph, the four-roller type sizing mill of this example of the present invention achieved a sizing-precision two times as high as the tolerance according to JIS, or even higher.

According to the present invention, two pair of rollers of a four-roller mill are arranged leaving a distance L therebetween (the distance L as defined above). By setting the distance L within a suitable range, the four-roller mill of the present invention achieves both the advantages of the conventional two-roller mill and the advantages of the conventional four-roller mill. In other words, according to the present invention, a unit of four rollers can perform sizing with a widened range of rolling drafts while achieving a significantly high level of sizing precision.

Because a high level of sizing-precision is achieved, secondary processing, such as drawing or peeling, is not required. Because the range of rolling drafts for sizing of a unit of rollers is widened, it is unnecessary to frequently change units of rollers, thus reducing the amount of down time for changing rollers. As a result, operation efficiency is improved.

Because the number of component parts is reduced, the four-roller type sizing mill of the present invention achieves a reduced size and a simplified structure. The reduced size and simplified structure allow an increased space for arrangement and adjustment of four rollers. As a result, the roller gaps and the positions of the rollers along their axes can be adjusted by a screw down device and an axial position adjusting device with an improved precision. Further, the increased space around the rollers facilitates changing and maintaining the rollers.

Optionally, if pre-rotating devices are provided for pre-rotating non-driven rollers, the front end of a rolling material does not strongly hit but softly contacts the groove surfaces of the non-driven rollers when the front end portion is bitten by the rollers. Formation of flaws on the groove surface is thus avoided.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A four-roller type sizing mill apparatus for forming round steel rods, comprising two four-roller stands each having two pair of facing rollers, one pair of facing rollers is arranged in a rolling direction perpendicular to the rolling direction of the other pair of facing rollers, the two four-roller stands being arranged in line, with the rolling direction of one of the two four-roller stands being shifted by 45° from the rolling direction of the other four-roller stand, wherein the two pair of facing rollers of a first four-roller stand of the two four-roller stands are positioned closer to a rolling material inlet and are separated from each other by a distance which is greater than zero and not greater than five times a projected contact length of one of the pair of facing rollers positioned closer to the rolling material inlet, the distance being measured between a first standard straight line which passes through centers of one of the pair of facing rollers and lies on a plane parallel to side surfaces of the same pair of facing rollers and a second standard straight line obtained by projecting axes of the other pair of facing rollers onto the above-mentioned plane, wherein, in the first four-roller stand, the pair of facing rollers closer to the rolling material inlet are connected to roller driving means for transmitting to the same pair of facing rollers a torque large enough for the pair of facing rollers to roll a rolling material, and the other pair of facing rollers are not connected to roller driving means, and wherein, in the second four-roller stand, one of the two pair of facing rollers is connected to roller driving means for transmitting to the same pair of facing rollers a torque large enough for the pair of facing rollers to roll a rolling material, and the other pair of facing rollers are not connected to roller driving means, the pair of facing rollers in both the first and second four-roller stands which are not connected to roller driving means are provided with pre-rotating means for rotating the same pair of facing rollers by a torque smaller than the torque of the pair of facing rollers driven by the roller driving means but at substantially the same speed as the speed of the pair of facing rollers driven by the roller driving means at least when a front end portion of a rolling material is bitten by the pair of facing rollers which are not connected to roller driving means.

2. A four-roller type sizing mill apparatus according to claim 1, wherein the pre-rotating means includes a one-way clutch.

* * * * *